US005887868A

United States Patent [19]

Lambert et al.

[11] Patent Number: 5,887,868

[45] Date of Patent: Mar. 30, 1999

[54] DRIVE SYSTEM FOR ROLLERS

[75] Inventors: Thomas P. Lambert, Webster; Gregory A. Ludgate, Ontario, both of N.Y.

[73] Assignee: Xerox Corporation, Stamford, Conn.

[21] Appl. No.: 163,635

[22] Filed: Dec. 9, 1993

[51] Int. Cl.[6] ..... B65H 29/00

[52] U.S. Cl. ..... 271/186; 271/902

[58] Field of Search ..... 271/186, 65, 902, 271/184, 185, 225, 122

[56] References Cited

U.S. PATENT DOCUMENTS

| | | | |
|---|---|---|---|
| 4,105,199 | 8/1978 | Sato et al. | 271/122 |
| 4,359,217 | 11/1982 | Roller et al. | 271/186 |
| 4,365,794 | 12/1982 | Roller | 271/186 |
| 4,487,506 | 12/1984 | Repp et al. | 355/145 H |
| 4,579,446 | 4/1986 | Fujino et al. | 271/186 X |
| 5,131,649 | 7/1992 | Martin et al. | 271/65 X |

FOREIGN PATENT DOCUMENTS

| | | | |
|---|---|---|---|
| 59-97957 | 6/1984 | Japan | 271/65 |

OTHER PUBLICATIONS

Xerox Disclosure Journal, vol. 8, No. 2, Mar./Apr. 1983, disclosure entitled "Constant Force Spring Inverter" by George J. Roller.

*Primary Examiner*—David H. Bollinger
*Attorney, Agent, or Firm*—H. Fleischer

[57] ABSTRACT

An apparatus for moving a sheet bi-directionally. The apparatus includes a first roller and a second roller. A drive system is associated with the rollers to drive the first roller in a first direction. The drive system is adapted to rotate the second roller simultaneously with the first roller in the same direction as the first roller or in the opposite direction thereto. In addition, the drive system is capable of idling the second roller so as to adjust the timing of the sheet as it moves to subsequent processing stations within a printing machine.

8 Claims, 4 Drawing Sheets

DRIVE SYSTEM FOR ROLLERS

The present invention relates to an electrophotographic printing machine, and more particularly concerns an improved drive system for rotating rollers adapted to move sheets therein.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, a developer mix is brought into contact therewith. This forms a powder image on the photoconductive member which is subsequently transferred to a copy sheet. Finally, the copy sheet is heated to permanently affix the powder image thereto an image configuration.

In today's high-speed electrophotographic printing machines, the copy sheets are handled and advanced throughout the various processing stations thereof. Not only must each copy sheet be handled without marring or destroying the sheet but, also, misfeeds and multiple feeds must be prevented. The foregoing not only applies to copy sheets, but also to original documents being handled by document handling systems. It is sometimes necessary or desirable to reverse the orientation of the moving sheet. This may be required in order to produce duplex copies, i.e. to provide two-sided copying, or for other reasons known to those skilled in the art. Furthermore, it is frequently necessary to adjust the timing of the copy sheet as it advances towards a specific processing station. Thus, it may be desirable to hold the copy sheet in a selected position while downstream timing is adjusted.

Heretofore, various techniques have been employed to reverse the direction of movement of the sheet. These inverters must be capable of accommodating sheets which may vary widely in size, weight, thickness, material, condition, humidity, age, etc. These variations change the beam strength or flexual resistance and other characteristics of the sheet. Yet, under all of the foregoing varying conditions, the inverter must be capable of handling the sheets without jams, misfeeds, or uneven feeding times in order to insure the necessary ability for handling the sheet in proper time relative to the various processing stations within the printing machine. In a typical inverter, the sheet is driven by feed rollers or other suitable sheet driving mechanisms into a sheet reversing chute. By reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the inverter is located at the corner of a 90 to 100 degree inherent bend in the copy sheet path, the inverter may be used to actually prevent inverting of a sheet to that point, i.e. to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change the sheet orientation.

Inverters are also particularly useful in various systems of pre or post collation copying, for inverting the original documents, or for maintaining proper collation of the sheets. The orientation of the original document determines whether it may be stacked in a forward or reverse serial order to maintain collation. Generally, the inverter is associated with a by-pass sheet path and gate so that the sheet may selectively by-pass the inverter, to provide a choice of inversion or non-inversion.

In a typical inverter, a leading edge of the sheet moves through a roll nip into an inverter chute. The trailing or free end of the sheet is entirely pushed into the inverter chute by the rotating rollers. Thereafter, this sheet is immediately expelled through an exit passage in the inverter. In this way, the leading edge of the sheet becomes the trailing edge and the trailing edge becomes the leading edge thereof.

Various approaches have been devised to reverse the direction of movement of sheets and to control rotating rollers employed therein. The following disclosures may be relevant to various aspects of the present invention:

U.S. Pat. No. 4,359,217

Patentee: Roller et al.

Issued: Nov. 16, 1982

Xerox Disclosure Journal

Vol. 8, No. 2, March/April, 1983

Page 101

Author: Roller

U.S. Pat. No. 4,487,506

Patentee: Repp et al.

Issued: Dec. 11, 1984

The relevant portions of the foregoing disclosures may be briefly summarized as follows:

U.S. Pat. No. 4,359,217 discloses a tri-roll inverter. A pair of rollers define an input nip through which a sheet is advanced. These rollers drive the sheet into a chute and subsequently through nip defined by a second pair of rollers. Thereafter, the second pair of rollers reverse their direction of rotation to drive the sheet out of the chute. The leading edge of the sheet passes into a nip defined by another roller and one of the prior rollers. In this way, the sheet is reversed and the prior leading edge now becomes the trailing edge and the trailing edge the leading edge.

The Xerox Disclosure Journal article describes a tri-roll inverter having a constant spring force in back of the chute. An entering sheet passes through an entering nip and contacts the spring. The sheet compresses the spring. This provides a constant return force enabling the trailing edge of the sheet to make contact with the center roll of the inverter and to walk around the roll to the output nip and exit.

U.S. Pat. No. 4,487,506 discloses a dual purpose tri-roll inverter. In one mode of operation, the sheet enters the inverter chute and the direction thereof is reversed. In another mode of operation, the sheet enters the inverter chute and continues to move in the same direction therethrough so that the sheet is not inverted. Inversion or noninversion is determined by a pair of reversible rollers located at the end of the chute. In one direction of rotation, the rollers return the sheet to the tri-rolls while in the other direction of rotation, the rollers move the sheet away from the tri-rolls.

In accordance with one aspect of the present invention, there is provided an apparatus for moving a sheet. The apparatus includes a first roller and a second roller. Means are provided for rotating the first roller in a first direction. The rotating means is adapted to rotate the second roller simultaneously with the first roller or to enable the second roller to idle simultaneously with the first roller rotating in the first direction.

Pursuant to another aspect of the present invention, there is provided an apparatus for inverting a sheet. The apparatus includes an inversion channel, a first roller and a second roller. A third roller defines an entrance nip with the first roller to move the sheet into the inversion channel. The third roller is rotated by the first roller. A fourth roller defines an exit nip with the first roller to move the sheet from the inversion channel. The fourth roller is rotated by the first roller. A fifth roller defines a nip with the second roller in the inversion channel. The fifth roller is rotated by the second roller. Means are provided for rotating the first roller in a first direction. The rotating means is adapted to rotate the second roller simultaneously with the first roller or to enable the second roller to idle simultaneously with the first roller rotating in the first direction.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
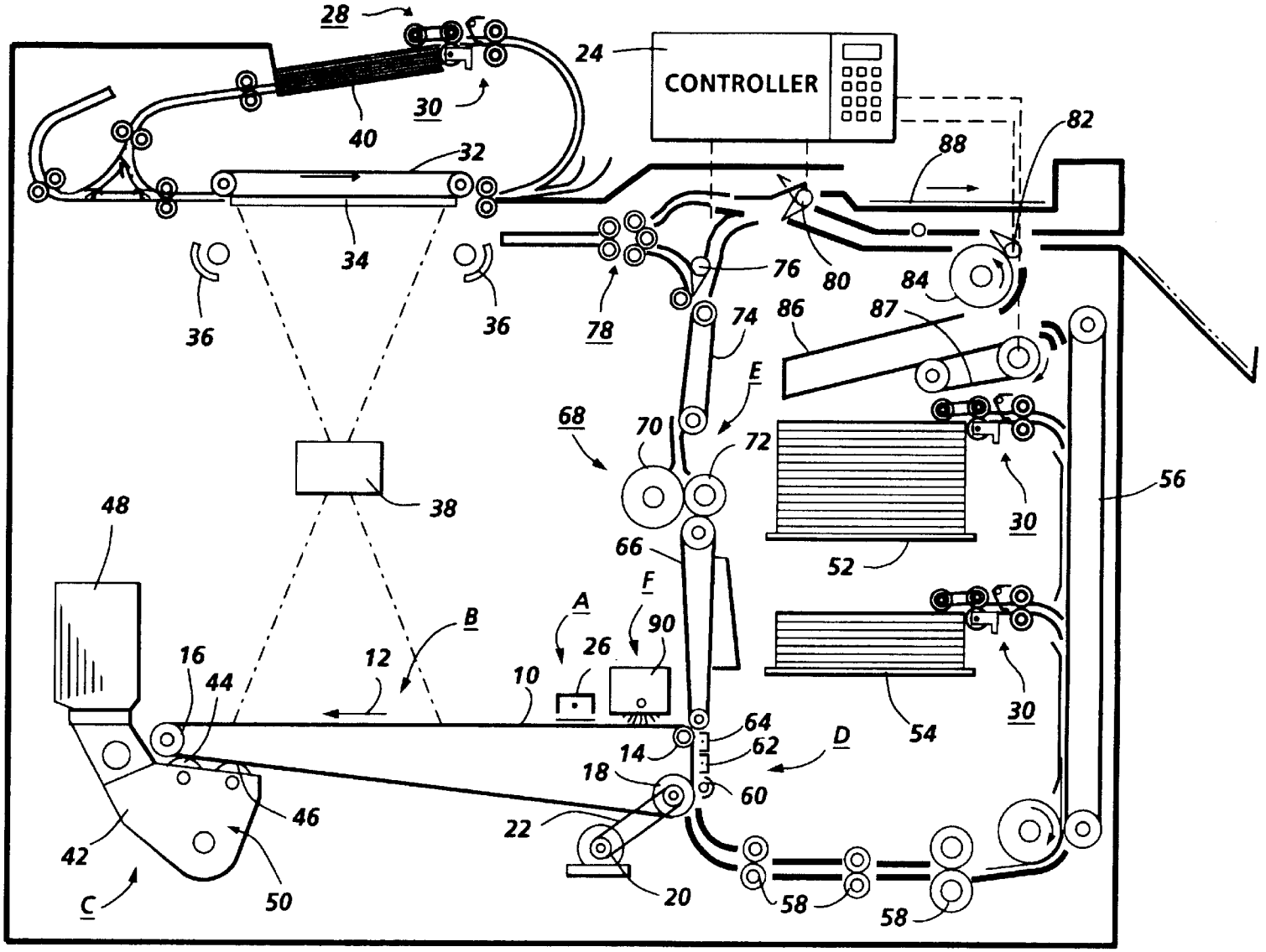
FIG. 5 is a schematic, elevational view showing an illustrative electrophotographic printing machine incorporating the features of the present invention therein.

For a general understanding of the features of the present invention, references are made to the drawings. In the drawings, like Reference numerals have been used throughout to designate identical elements. FIG. 5 schematically depicts the various components of an illustrative electrophotographic printing machine incorporating the drive system of the present invention therein. It will become apparent from the following discussion that this drive system is equally well-suited for use in a wide variety of printing machines and is not necessarily limited in its application to the particular embodiment shown herein. For example, as described hereinafter, the drive system of the present invention is disclosed in use with a sheet inverter. However, that system may be used to forward and control the movement of any rollers in the printing machine or for a document inverter as well as a copy sheet inverter.

Inasmuch as the art of electrophotographic printing is well known, the various processing stations in the FIG. 5 printing machine will hereinafter be shown schematically and their operation described briefly with reference thereto.

As shown in FIG. 5, the illustrative electrophotographic printing machine employs a belt 10 having a photoconductive surface comprising an anti-curl layer, a supporting substrate layer and an electrophotographic imaging single layer or multiple layers. The imaging layers may contain homogeneous, heterogeneous, inorganic or organic composition. Preferably, finely divided particles of the photoconductive inorganic compound are dispersed in an electrically insulating organic resin binder. Typically, photoconductive particles include metal free phthalocyanine, such as copper phthalocyanine, quinacridones, 2,4-diamino-triazines and polynuclear aromatic quinines. Typical organic resin binders include polycarbonates, acrylic polymers, vinyl polymers, cellulose polymers, polyesters, polysiloxanes, polyamides, polyurethanes, epoxies, and the like. Other well-known electrophotographic imaging layers include amorphous selenium, halogen doped-dye-morphous selenium, amorphous selenium, amorphous selenium alloids (including selenium arsenic, selenium tolarium and selenium arsenic antimony), and halogen doped-selenium alloys, canmeum alloys, canmeum sulphide, and the like. Generally, these inorganic photoconductive materials are deposited as a relatively homogeneous layer. The anti-curling layer may be made of any suitable film such as a flexible thermoplastic resin with reactive groups which will react with reactive groups on a coupling agent molecule. Typical thermoplastic resins include polycarbonates, polyesters, polyurethanes, acrylic polymers, vinyl polymers, cellulose polymers, polysiloxanes, polyminds, polyurethanes, epoxies, nylon, polybutadiene, natural rubber, and the like. A film forming a binder of polycarbonate resin is particularly preferred because of its excellent adhesion to adjacent layers and transparency to activating radiation. The substrate layer may be made from any suitable conductive material such as Mylar. Another well known conductive material that can be used in the substrate layer is aluminum. Belt 10 moves in the direction of arrow 12 to advance successive portions of the photoconductive surface sequentially through the processing stations disposed about the path of movement thereof.

Belt 10 is entrained about stripping roller 14, tensioning roller 16, and drive roller 18. Stripping roller 14 is mounted rotatably so as to rotate with belt 10. Tensioning roller 16 is resiliently urged against belt 10 to maintain belt under the desired tension. Drive roller 18 is rotated by a motor coupled thereto by suitable means, such as a belt drive 22. A controller 24 controls the motor 20 in a manner known to one skilled in the art to rotate the roller 18. As the drive roller 18 rotates, it advances belt 10 in the direction of arrow 12.

Initially, a portion of the photoconductive surface passes through charging station A. At charging station A, a corona generating device, indicated generally by the reference numeral 26, charges the photoconductive surface to a relatively high, substantially uniform potential.

Next, the charged portion of the photoconductive surface is advanced to imaging station B. Imaging station B includes a document handling unit indicated generally by the reference numeral 28. Document handling unit 28 sequentially feeds successive original documents from a stack of original documents placed by the operator face up in the normal forward collated order on the document handling and supporting tray. The upper most sheet of the stack of documents is placed closely adjacent to a sheet feeder, indicated generally by the reference numeral 30. Sheet feeder 30 advances the topmost sheet from the stack of documents to transport belt 32. Transport belt 32 advances the original document to platen 34. At platen 34, the original document is positioned face-down. Lamps 36 illuminate the original document on transparent platen 34. A light ray is reflected from the original document and transmitted through lens 38. Lens 38 forms the light image of the original document which is projected onto the charged portion of the photoconductive surface of belt 10 to selectively dissipate the charge thereon. This records an electrostatic latent image on the photoconductive surface which corresponds to the informational areas contained within the original document. Transport belt 32 then returns the imaged document to the bottom of the stack of documents supported on tray 40.

After imaging, belt 10 advances the electrostatic latent image recorded on the photoconductive surface to development station C. At development station C, a magnetic brush developer unit, indicated generally by the reference numeral 42, advances the developer material into contact with the electrostatic latent image recorded on the photoconductive surface of belt 10. Preferably, magnetic brush development unit 42 includes two magnetic brush developer rollers 44 and 46. These rollers each advance developer material into contact with the latent image. Each developer roller forms a brush comprising carrier granules and toner particles. The latent image attracts the toner particles from the carrying granules forming a toner powder image on the photoconductive surface of belt 10. As successive latent images are developed, particles are depleted from developer unit 42. A toner powder dispenser 48 is arranged to furnish additional toner particles to developer housing 50 for subsequent development by the developer unit. The toner particle dispenser 48 stores a supply of toner particles which are subsequently dispensed into the developer housing to maintain the concentration of toner particles therein substantially uniform. After the latent image is developed with toner particles to form a toner powder image on the photoconductive surface of belt 10, belt 10 advances the toner powder image to transfer station D.

At transfer station D, a copy sheet is moved into contact with the toner powder image recorded on the photoconductive surface of belt 10. The copy sheets are fed from either trays 52 or 54. Each of these trays has a stack of sheets thereon. Sheet feeder 30 is also used herein to advance the topmost sheet of the stack. Conveyor 56 receives the sheet advanced from the respective feed tray by sheet feeder 30 and advances it to feed rolls 58. Feed rolls 58 advance the sheet to transfer station D. Prior to transfer, lamp 60 illuminates the toner powder image adhering to the photoconductive surface of belt 10 to reduce the attraction therebetween. Thereafter, a corona generating device 62 sprays ions onto the backside of the copy sheet. The copy sheet is charged to the proper magnitude and polarity so that the copy sheet is tacked to the photoconductive surface of belt 10 and the toner powder image attracted thereto. After transfer, a corona generating device 64 charges the copy sheet to the opposite polarity to detack the sheet from belt 10. Conveyor 66 advances the copy sheet to fusing station E.

Fusing station E includes a fuser assembly, indicated generally by the reference numeral 68, which permanently affixes the transferred toner powder image to the copy sheet. Preferably, fuser assembly 68 includes heated fuser roller 70 and back-up roller 72 with the powder image on the copy sheet contacting the fuser roll 70. The back-up roller 72 is cammed against the fuser roller 70 to provide the necessary pressure to permanently affix the toner powder image to the copy sheet. After fusing, conveyor 74 advances the copy sheet to gate 76. Gate 76 functions as an inverter selector. Depending upon the position of gate 76, the copy sheet will either be deflected into a sheet inverter, indicated generally by the reference numeral 78, or bypass inverter 78 and be fed directly into a second decision gate 80. The detailed structure of inverter 78 will be described hereinafter with reference to FIGS. 1–4, inclusive. Those copies which bypass inverter 78 are inverted so that the image side, which has been transferred and fused, is face-up at this point. However, if the inverter path is selected, the opposite is true, i.e. the last printed face is down. Decision gate 82 then either deflects the sheet directly into an output tray 88 or deflects the sheets into a transport path which carries them on without inversion to a third decision gate 82. Gate 82 either passes the sheet directly on without inversion or into the output path of the printing machine or deflects the sheet into a duplex inverting roller transport 84. Inverting roller 84 inverts and stacks the sheets to be duplexed in duplex tray 86, when required by gate 82. Duplex tray 86 provides buffer storage for those copies which have been printed on one side and on which an image will be printed subsequently on the opposed side. Due to the sheet inverting by roller 84, those copy sheets are stacked in duplex tray 86 face down. They are stacked in duplex tray 86 on top of one another in the order in which they are initially copied. In order to complete duplex copying, the copy sheets in duplex tray 86 are fed, in seriatim, by bottom sheet feeder 87 back to transfer station D by conveyor 56 and transport rollers 58. At transfer station D, the second or opposed side of the copy sheet has a toner powder image transferred thereto. The duplex copy sheets are then fed out through the same path through fusing station E past inverter 78 to be stacked in tray 88 for subsequent removal therefrom by the machine operator.

Invariably, after the copy sheet is separated from the photoconductive surface of belt 10 at transfer station D, some residual particles remain adhering thereto. These residual particles are removed from the photoconductive surface at cleaning station F which includes a rotatably mounted fibrous brush 90 in contact with the photoconductive surface. The particles are cleaned from the photoconductive surface by the rotation of the brush in contact therewith. Subsequent to cleaning, a discharge lamp (not shown) floods the photoconductive surface with light to dissipate any residual or electrostatic charge remaining thereon prior to the charging thereof for the next cycle.

Controller 24 is preferably a programmable microprocessor which controls all of the machine steps and functions heretofor described. The controller controls the document copy sheets, gates, feeder drives, etc. Controller 24 also provides for storage and comparison of the counts of the copy sheets, the number of documents recirculated in a document set and the number of copy sets selected by the operator through the switches, time delays, jams correction control, etc. The control of the inverter may be accomplished by activating it appropriately through signals from the controller in response to simple program commands from switch inputs from the buttons selected by the operator on the console. Alternatively, the movement of the sheet in the inverter may also be controlled automatically in response to the sensing of the sheet and the determination of sheet jams, multi-sheet feeds in either or both the sheet feeder and/or document handler. Exemplary control systems for use in electrophotographic printing machines are described in U.S. Pat. No. 4,062,061, issued Dec. 6, 1977 to Batchelor et al., U.S. Pat. No. 4,132,155 issued Oct. 31, 1978 to Upert, U.S. Pat. No. 4,125,325 issued Nov. 14, 1978 to Betchler et al., and U.S. Pat. No. 4,144,550 issued Mar. 13, 1979 to Donohue et al., the relevant portions of the foregoing patents being incorporated into the present application.

It is believed that the foregoing description is sufficient for purposes of the present application to illustrate the general operation of an electrophotographic printing machine incorporating the invertor and drive system of the present invention therein.

Figure 1:
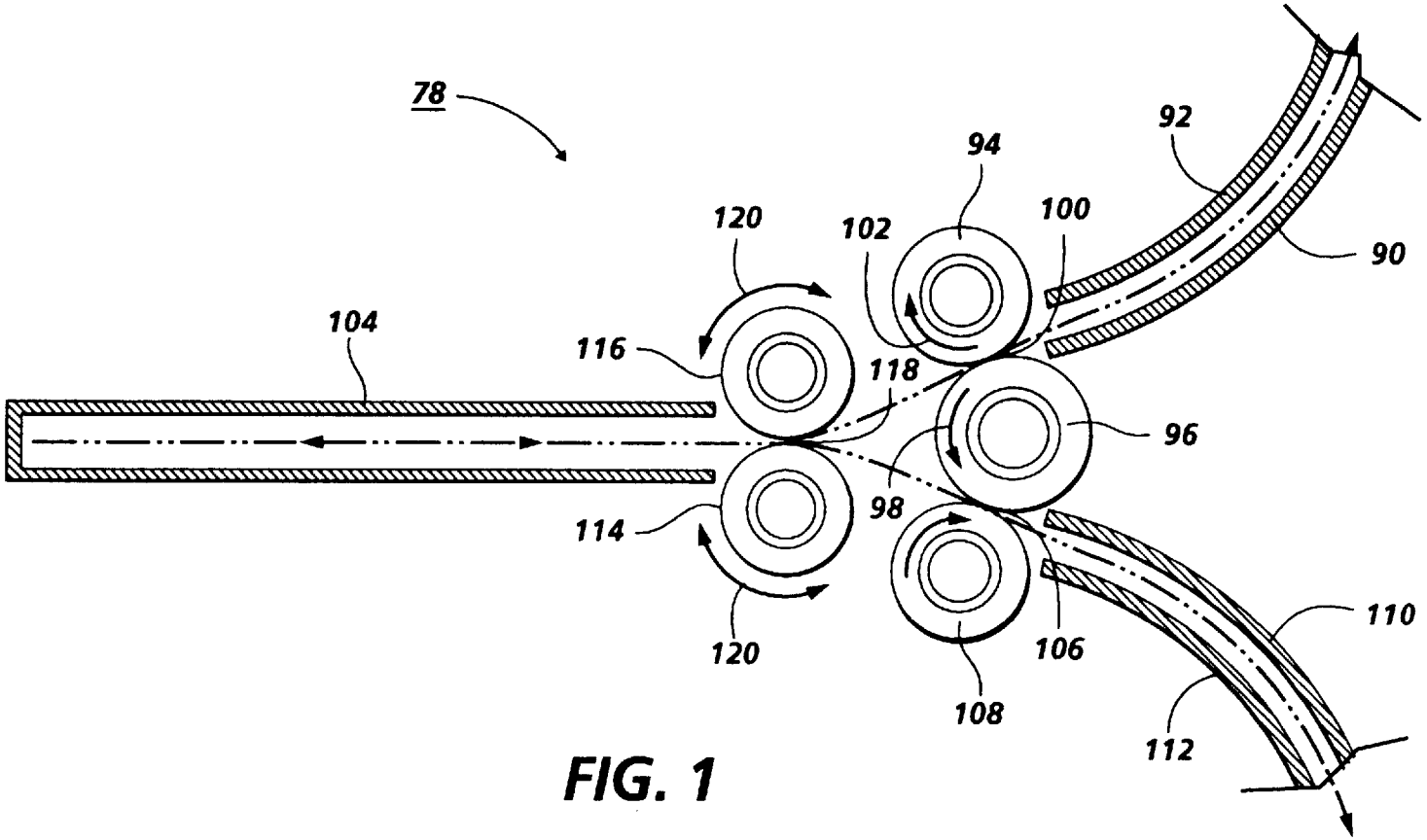
FIG. 1 is a schematic, elevational view showing a tri-roll inverter incorporating the features of the present invention therein.

As shown in FIG. 1, inverter 78 includes a pair of spaced guide members 90 and 92 which direct sheets to a first pair of rolls 94 and 96. Roll 96 is driven by an operatively associated external drive in the direction of arrow 98. Rolls 94 and 96 are positioned in opposed relationship to define a first drive nip 100. Roll 96 engages roll 94 at nip 100 and causes roll 94 to rotate in the direction of arrow 102. The first drive nip 100 is used to direct incoming sheets into inverter chute 104. An exit drive nip 106 is defined by rolls 96 and 108 in engagement with one another. Rolls 96 and 108 are positioned in opposed relationship with one another. As with roll 94, roll 108 is non-powered, and merely rotates with the driven roll 96. Thus, rolls 94 and 108 are idler rollers. An exit chute is defined by a pair of spaced upper and lower exit guide panels 110 and 112, respectively, which direct the exiting sheet to subsequent downstream operations of the printing machine hereinbefore described with reference to FIG. 5. Rollers 114 and 116 are located at the entrance to chute 104. Rollers 114 and 116 are in engagement with one another to define a nip 118. Roller 114 is driven by an external drive source bidirectionally as indicated by arrow 120. Roller 116 is driven by roller 114 and is an idler roller. Thus, roller 116 also moves bidirectionally, as indicated by arrow 120.

In operation, a sheet passes between guide plates 90 and 92 and the lead edge enters nip 100. Rollers 94 and 96 advance the lead edge of the sheet into nip 118. Rollers 114 and 116 rotating in a counter clockwise and clockwise direction, respectively, advance the lead edge of the sheet into chute 104. Thereafter, the control system of the printing machine decouples the drive system from roller 114 so as to maintain the sheet in chute 104 for the appropriate duration of time. After the appropriate duration of time has elapsed, rollers 114 and 116 reverse their direction of rotation. At this time, the sheet now exits chute 104 and enters nip 106 defined by rollers 106 and 108. As rollers 96 and 108 rotate, the sheet is advanced between exit guides 110 and 112 to be further processed in the electrophotographic printing machine of FIG. 5.

Figure 2:
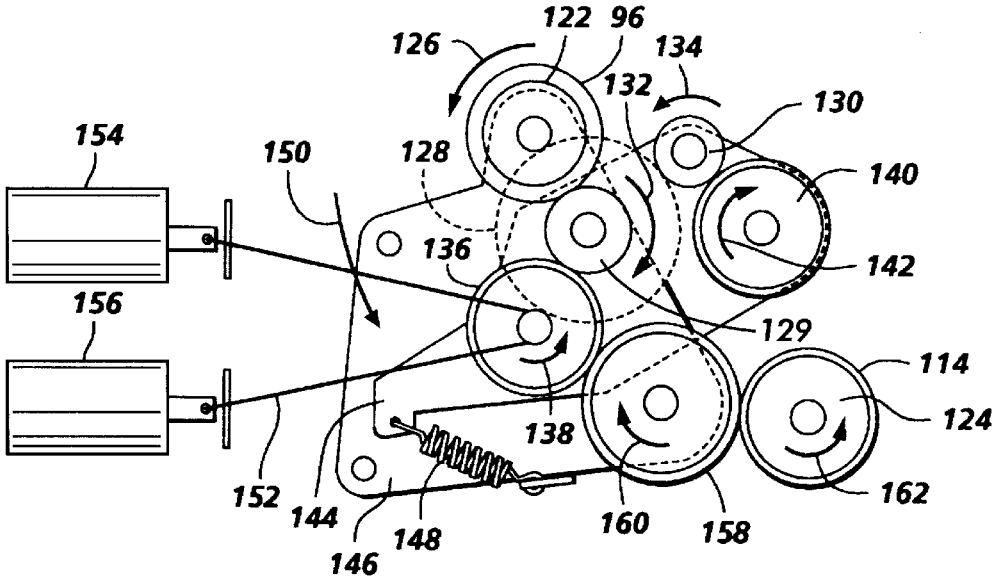
FIG. 2 is a schematic, elevational view showing the drive system for rotating one of the rolls of the tri-roll inverter in one direction and the other roll thereof in the same direction.
Figure 3:
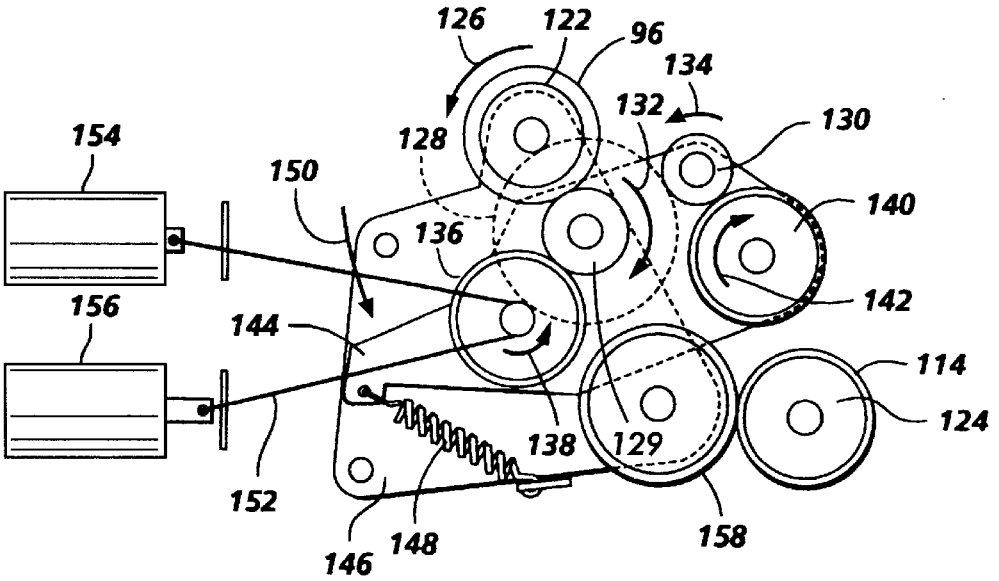
FIG. 3 is a schematic, elevational view showing the FIG. 2 drive system with the other roll idling.
Figure 4:
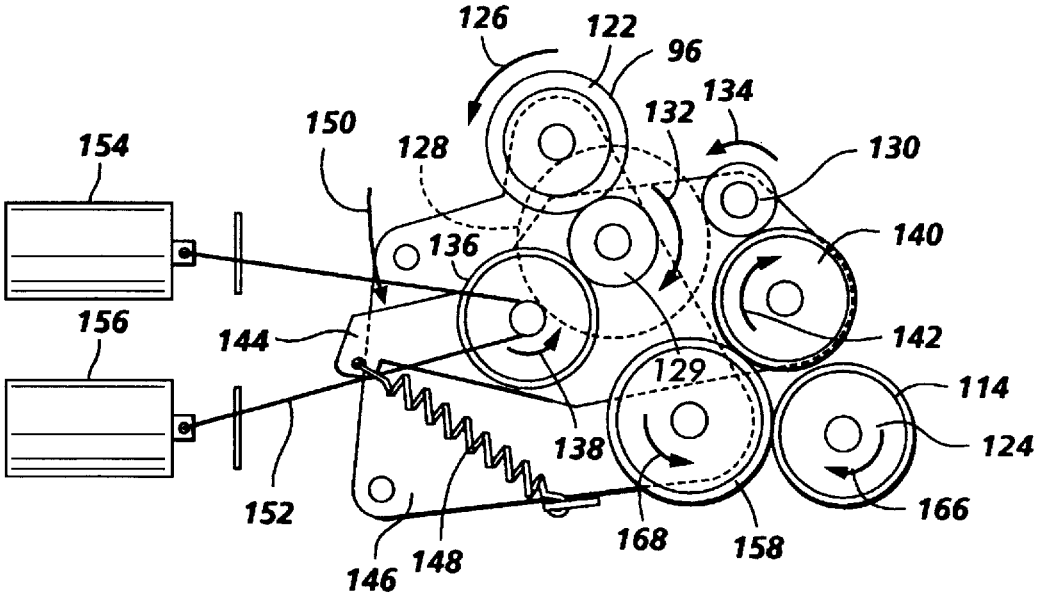
FIG. 4 is a schematic, elevational view showing the other roller rotating in the opposite direction to that of FIG. 2.

Turning now to FIGS. 2–4, inclusive, the details of the drive system for the rollers will be described hereinafter. Initially referring to FIG. 2, a gear 122 rotates in unison with roller 96. Similarly, a gear 124 rotates in unison with roller 114. Gear 122 is driven by a motor (not shown) in the direction of arrow 126. The motor drives gear 122 and roller 96 at a substantially constant angular velocity. Gear 122 meshes with gear 129. Gear 128 meshes with gear 130. Gear 128 is mounted on a common shaft with gear 129 and rotates in unison therewith. Gear 128 rotates in the direction of arrow 132 and gear 130 rotates in the direction of arrow 134. Gear 129 also meshes with gear 136. Gear 136 rotates in the direction of arrow 138. Gear 130 meshes with gear 140 which rotates in the direction of arrow 142. Gears 128, 130, 136 and 140 are mounted on frame 144. Frame 144 is mounted preferably on support 146. A spring 148 has one end thereof connected to frame 144 and the other end thereof connected to support 146. Spring 148 resiliently urges frame 144 to pivot in the direction of arrow 150. A flexible wire or cable 152 is connected to frame 144. One end of wire 152 is connected to the plunger of solenoid 154. The other end of wire 152 is connected to the plunger of solenoid 156. As shown in FIG. 2, when solenoid 154 and solenoid 156 are both de-energized, spring 148 resiliently urges frame 144 to pivot in the direction of arrow 150 with respect to support 146 so that gear 136 meshes with gear 158. This causes gear 158 to rotate in the direction of arrow 160. Gear 158 meshes with gear 124. As gear 158 rotates in the direction of arrow 160, it drives gear 124 to rotate in the direction of arrow 162. Roller 114 rotates in unison with gear 124 in the direction of arrow 162. Thus, roller 96 and roller 114 rotate in the same direction when solenoids 154 and 156 are de-energized.

Referring now to FIG. 3, there is shown solenoid 154 energized and solenoid 156 de-energized. Under these circumstances, spring 148 pivots frame 144 relative to support 146 in the direction of arrow 150 a distance such that gear 136 and gear 140 are disengaged from gear 158. Thus, neither gear 136 nor gear 140 drive gear 158. Gear 158 remains stationary as does gear 124. Inasmuch as gear 124 remains stationary, roller 114 remains stationary and in an idle position.

Referring now to FIG. 4, solenoid 154 and solenoid 156 are both energized. This causes spring 148 to pivot frame 144 relative to support 146 a distance such that gear 140 meshes with gear 158 and gear 136 is spaced therefrom. Under these circumstances, gear 114 rotates in the direction of arrow 166, which is in the opposite direction to that of arrow 126. Thus, roller 114 rotates in the opposite direction to that of roller 96.

In recapitulation, it is clear that the improved drive system enables rollers lodged in an inverter to rotate bi-directionally or to cease rotating altogether. This enables the sheet to be driven into the chute of the inverter and out therefrom. Furthermore, the sheet may be maintained in the chute for any period of selected time to adjust the timing of the sheet entering subsequent processing stations in the printing machine.

It is, therefore, evident that there has been provided in accordance with the present invention a roller drive system which fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations which may fall within the spirit and scope of the appended claims.

What is claimed is:

1. An apparatus for moving a sheet, including:

a first roller;

a second roller; and means for rotating said first roller in a first direction, said rotating means being adapted to rotate said second roller simultaneously with said first roller and being adapted to enable said second roller to idle simultaneously with said first roller rotating in the first direction, said rotating means rotates said second roller in the first direction and in a second direction opposed to the first direction, said rotating means comprises first drive means for rotating said roller in the first direction, second drive means, driven by said first drive means for rotation in the second direction, third drive means for driving said second roller, and means for coupling said second drive means to said third drive means to rotate said second roller in the second direction and de-coupling said first drive means from said third drive means, said coupling means being adapted to de-couple said second drive means from said third drive means and couple said first drive means to said third drive means to rotate said second roller in the first direction, said coupling means being adapted to de-couple said first drive means from said third drive means and said second drive means from said third drive means to idle said second roller, said coupling means includes a first solenoid, a second solenoid, and a flexible wire coupling said first solenoid and said second solenoid to said first drive means.

2. An apparatus according to claim 1, wherein:

said first solenoid and said second solenoid are energized to couple said second drive means to said third drive means to rotate said second roller in the second direction;

said first solenoid and said second solenoid are de-energized to couple said first drive means to said third drive means to rotate said second roller in the first direction; and said first solenoid is energized and said second solenoid is de-energized to de-couple said first drive means from said third drive means and said second drive means from said third drive means to idle said second roller.

3. An apparatus according to claim 2, wherein:

said first drive means includes a first gear adapted to rotate in unison with said first roller in the first direction, a second gear meshing with said first gear to rotate in the second direction, a third gear rotating in unison with said second gear, and a fourth gear meshing with said second gear to rotate in the first direction;

said second drive means includes a fifth gear meshing with said third gear to rotate in the first direction, and a sixth gear meshing with said fifth gear to rotate in the second direction;

said third drive means includes a seventh gear adapted to rotate in unison with said second roller, and a eighth gear meshing with said seventh gear, said eighth gear meshing with said fourth gear in response to said first solenoid and said second solenoid being de-energized to rotate said second roller in the first direction, said eighth gear meshing with said sixth gear in response to said first and said second solenoid being energized to rotate said second roller in the first direction, and said eighth gear being spaced from said fourth gear and said sixth gear in response to said first solenoid being energized and said second solenoid being de-energized.

4. An apparatus according to claim 3, further including:

a pivotably mounted frame having said first gear, said second gear, said third gear, said fourth gear, said fifth gear and said sixth gear mounted thereon; and means for resiliently urging said frame to pivot in the first direction, said flexible wire being connected to said frame so that energization of said first solenoid and said second solenoid enables said urging means to pivot said frame a distance such that said sixth gear meshes with said eighth gear rotating said second roller in the second direction with de-energization of said first solenoid and said second solenoid enabling said urging means to pivot said frame a distance such that said forth gear meshes with said eighth gear rotating said second roller in the first direction, and energization of said first solenoid and de-energization of said second solenoid enables said urging means to pivot a distance spacing said eighth gear from said sixth gear and said fourth gear idling said second roller.

5. An apparatus for inverting a sheet, including:

an inversion channel;

a first roller;

a second roller;

a third roller defining an entrance nip with said first roller to move the sheet into said inversion channel, said third roller being rotated by said first roller;

a fourth roller defining an exit nip with said first roller to move the sheet from said inversion, said fourth roller being rotated by said first roller;

a fifth roller defining a nip with said second roller in said inversion channel, said fifth roller being rotated by said second roller; and means for rotating said first roller in a first direction, said rotating means being adapted to rotate said second roller simultaneously with said first roller or being adapted to enable said second roller to idle simultaneously with said first roller rotating in the first direction, said rotating means rotates said second roller in the first direction or in a second direction opposed to the first direction, said rotating means comprising first drive means for rotating said first roller in the first direction, second drive means, driven by said first drive means, for rotation in the second direction, third drive means for driving said second roller, and means for coupling said second drive means to said third drive means to rotate said second roller in the second direction and decoupling said first drive means from said third drive means, said coupling means being adapted to decouple said second drive means from said third drive means and couple said first drive means to said third drive means to rotate said second roller in the first direction, said coupling means being adapted to decouple said first drive means from said third drive means and said second drive means from said third drive means to idle said second roller, said coupling means includes a first solenoid, a second solenoid, and a flexible wire coupling said first solenoid and said second solenoid to said first drive means.

6. An apparatus according to claim 5, wherein:

said first solenoid and said second solenoid are energized to couple said second drive means to said third drive means to rotate said second roller in the second direction;

said first solenoid and said second solenoid are de-energized to couple said first drive means to said third drive means to rotate said second roller in the first direction; and said first solenoid is energized and said second solenoid is de-energized to de-couple said first drive means from said third drive means and said second drive means from said third drive means to idle said second roller.

7. An apparatus according to claim 6, wherein said first drive means includes a first gear adapted to rotate in unison with said first roller in the first direction, a second gear meshing with said first gear to rotate in the second direction, a third gear gear rotating in unison with said second gear, and a fourth gear meshing with said second gear to rotate in the first direction;

said second drive means includes a fifth gear meshing with said third gear to rotate in the first direction, and a sixth gear meshing with said fifth gear to rotate in the second direction;

said third drive means includes a seventh gear adapted to rotate in unison with said second roller, and a eighth gear meshing with said seventh gear, said eighth gear meshing with said fourth gear in response to said first solenoid and said second solenoid being de-energized to rotate said second roller in the first direction, said eighth gear meshing with said sixth gear in response to said first and said second solenoid being energized to rotate said second roller in the first direction, and said eighth gear being spaced from said fourth gear and said sixth gear in response to said first solenoid being energized and said second solenoid being de-energized.

8. An apparatus according to claim 7, further including:

a pivotably mounted frame having said first gear, said second gear, said third gear, said fourth gear, said fifth gear and said sixth gear mounted thereon; and means for resiliently urging said frame to pivot in the first direction, said flexible wire being connected to said frame so that energization of said first solenoid and said second solenoid enables said urging means to pivot said frame a distance such that said sixth gear meshes with said eighth gear rotating said second roller in the second direction with de-energization of said first solenoid and said second solenoid enabling said urging means to pivot said frame a distance such that said forth gear meshes with said eighth gear rotating said second roller in the first direction, and energization of said first solenoid and de-energization of said second solenoid enables said urging means to pivot a distance spacing said eighth gear from said sixth gear and said fourth gear idling said second roller.

* * * * *